US005629712A

United States Patent [19]

Adrian et al.

[11] Patent Number: 5,629,712

[45] Date of Patent: May 13, 1997

[54] VEHICULAR SLOT ANTENNA CONCEALED IN EXTERIOR TRIM ACCESSORY

[75] Inventors: Andrew Adrian, Dexter; Timothy J. Talty, Trenton; Bruce R. Jones, Romulus, all of Mich.

[73] Assignee: Ford Motor Company, Dearborn, Mich.

[21] Appl. No.: 540,113

[22] Filed: Oct. 6, 1995

[51] Int. Cl.[6] ..... H01Q 1/32; H01Q 11/12

[52] U.S. Cl. ..... 343/713; 343/741; 343/744; 343/830

[58] Field of Search ..... 343/711, 712, 343/713, 742, 743, 744, 748, 828, 830

[56] References Cited

U.S. PATENT DOCUMENTS

| | | | |
|---|---|---|---|
| 2,923,813 | 2/1960 | Davis | 343/712 |
| 4,080,603 | 3/1978 | Moody | 343/744 |
| 4,329,691 | 5/1982 | Prewitt | 343/713 |
| 4,535,336 | 8/1985 | Shaver | 343/713 |
| 4,707,700 | 11/1987 | Nagy | 343/700 |
| 4,721,963 | 1/1988 | Nagy et al. | 343/712 |
| 4,737,795 | 4/1988 | Nagy et al. | 343/712 |
| 4,760,402 | 7/1988 | Mizuno et al. | 343/713 |
| 4,769,655 | 9/1988 | Nagy et al. | 343/712 |
| 4,866,453 | 9/1989 | Nagy et al. | 343/712 |
| 5,012,255 | 4/1991 | Becker | 343/704 |
| 5,106,141 | 4/1992 | Mostashari | 296/24.1 |
| 5,124,714 | 6/1992 | Harada | 343/713 |
| 5,177,493 | 1/1993 | Kawamura | 343/711 |
| 5,177,494 | 1/1993 | Dorrie et al. | 343/711 |
| 5,400,042 | 3/1995 | Tulintseff | 343/727 |
| 5,442,368 | 8/1995 | Harada et al. | 343/713 |
| 5,457,470 | 10/1995 | Hai et al. | 343/828 |

*Primary Examiner*—Donald T. Hajec
*Assistant Examiner*—Tan Ho
*Attorney, Agent, or Firm*—Mark Mollon

[57] ABSTRACT

A vehicular radio reception antenna is concealed within a body trim piece such as a spoiler or a luggage rack. A supporting body panel is utilized as a ground plane and a conductive loop is concealed within the trim piece. A transmission line connects two opposite sides of the resulting slot. Capacitors are used to connect the conducting loop to the sheet metal ground plane in order to form a dual slot/monopole antenna for receiving both FM and AM signals.

9 Claims, 3 Drawing Sheets

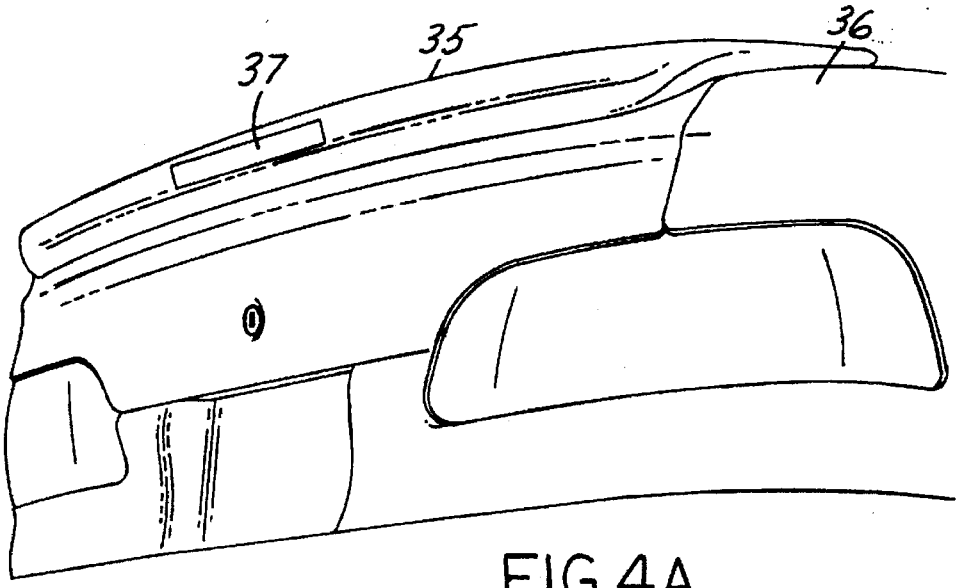
FIG. 4A
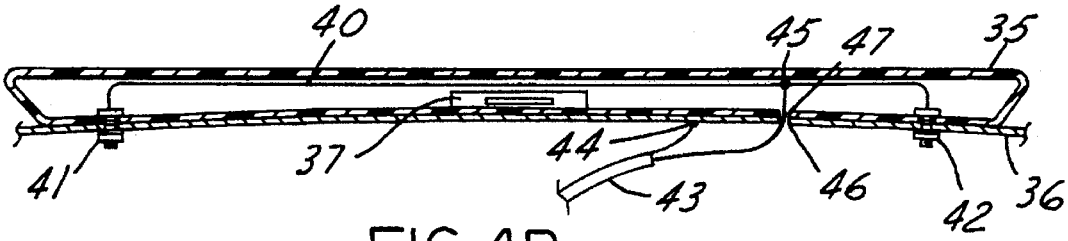
FIG. 4B
FIG. 5
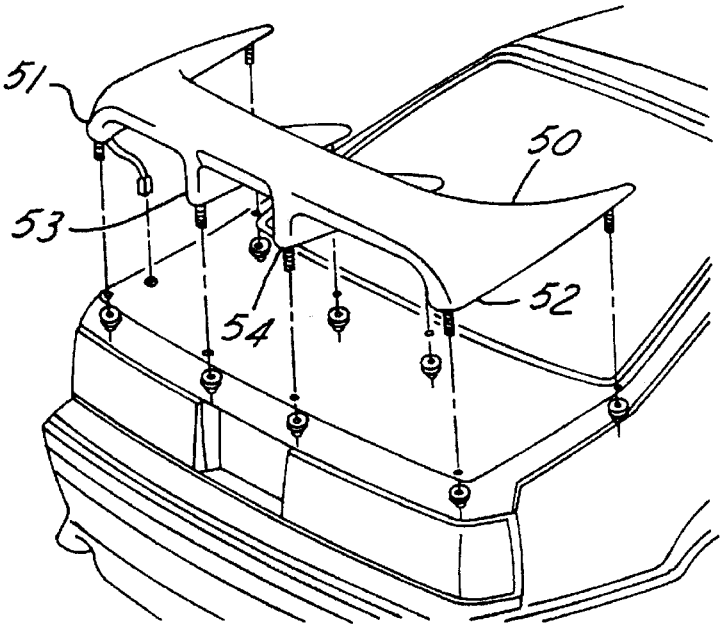

VEHICULAR SLOT ANTENNA CONCEALED IN EXTERIOR TRIM ACCESSORY

BACKGROUND OF THE INVENTION

This application is related to copending application U.S. Ser. No. 08/540,114, entitled "Mounting Structure for Combined Automotive Trim Accessory and Antenna", filed concurrently herewith and incorporated herein by reference.

The present invention relates in general to a concealed antenna for use on a vehicle and more specifically to a dual FM slot and AM monopole antenna that can be concealed within an exterior trim accessory such as a spoiler.

The most commonly used type of antenna for radio reception in automotive vehicle has been the standard whip antenna. The whip antenna has been desirable because of its good antenna performance in terms of antenna gain and directionality. Nevertheless, automotive manufacturers have sought alternatives to whip antennas because whip antennas are susceptible to damage (e.g., being bent or broken off), create wind noise, and are unattractive from a styling standpoint. However, concealed antenna designs which provide performance comparable to whip antennas and which may be made at a low cost have remained elusive.

The slot antenna is one type of concealed antenna that has been employed on automotive vehicles. A slot may be formed by a window aperture or by special composite materials used for body panels. Slot antennas, however, have not been well suited to reception in more than one frequency band. In slot antenna design, a slot is provided with a length about equal to one half the wavelength of the desired radio signals to be received. Thus, a single slot antenna is not well suited to receive both AM and FM radio signals because of the great difference between AM and FM wavelengths. Multiple slot antennas can be provided to obtain reception in multiple frequency bands, but a multiple slot design results in increase cost. Likewise, slot antenna designs employing body panels formed of composite materials are relatively expensive.

An on-glass antenna is another type of conformal (i.e., concealed) antenna. Antenna conductors are typically deposited on glass sheets in patterns that form separate FM and AM antennas. Typically, the AM antenna conductors also function as the heater grid for the glass window. However, in order to combine the AM and FM signal onto one transmission line to the radio receiver, special electronics are required to isolate the AM signals from the heater grid power voltage and to introduce the AM and FM signals to the coaxial transmission line. These special electronics typically require an additional electronic module and result in increased expense.

SUMMARY OF THE INVENTION

The present invention has the advantages of providing good antenna performance in a concealed antenna which can be manufactured at a low cost. The antenna can provide dual operating modes for receiving separate antenna bands, such as AM and. FM.

In one aspect, the invention provides a vehicular antenna comprising a sheet metal ground plane (such as a deck lid) and a body trim piece elevated over the ground plane (such as a spoiler). A conducting loop passes through the trim piece and is connected through the ground plane at first and second points whereby the conducting loop circumscribes a slot area between the sheet metal ground plane and the conducting loop. A transmission line with first and second conductors its the first conductor connected to the ground plane at a third point. The second conductor of the transmission line is connected to the conducting loop at a fourth point located along the slot area between the first and second points opposite the ground plane. First and second capacitors may couple the conducting loop to the sheet metal ground plane at the first and second points in order to provide monopole rather than slot operation at a second frequency band of radio reception.

BRIEF DESCRIPTION OF THE DRAWINGS

FIG. 4A is a perspective view of an alternative spoiler embodiment.

FIG. 4B is a cross-sectional view of the spoiler of FIG. 4A having the antenna mounted therein.

FIG. 5 is a perspective view of another spoiler embodiment.

DETAILED DESCRIPTION OF PREFERRED EMBODIMENTS

Vehicular slot antennas are discussed in copending and commonly assigned U.S. patent application Ser. No. 08/118,856, entitled "Slot Antenna with Reduced Ground Plane", filed Sep. 10, 1993, which is hereby incorporated by reference. The copending application teaches that while the surface area of the ground plane of a slot antenna is typically much greater than the slot area, slot antenna action can be obtained with a reduced-size ground plane. Thus, a reduced ground plane antenna comprises a loop of narrow conductive strip in a rectiform shape on a surface of a glass sheet. Antenna terminals are located on opposite sides of the reduced ground plane slots for feeding the slot antennas within the glass sheet.

Figure 1:
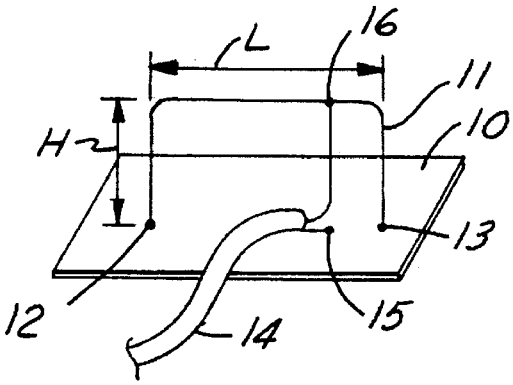
FIG. 1 is a perspective view of the antenna structure of the present invention.

Turning to FIG. 1, the slot antenna of this invention is shown to be constructed in three dimensions. A conductive ground plane 10 supports a conductive loop 11 extending above ground plane 10 between a first point 13 and a second point 12 thereby creating a slot area. Rather than being contained entirely within the plane of ground plane 10, the slot area is formed within the area circumscribed by conducting loop 11 and a line within ground plane 10 extending between points 12 and 13. The slot has a length L and a height H. A transmission line 14 (such as a coaxial cable) has first and second conductors connected to opposite sides of the slot. For example, transmission line 14 has a shield conductor connected to a third point 15 within ground plane 10 and a center conductor connected to a fourth point 16 in conductive loop 11. The position of points 15 and 16 along the length of the slot are selected to provide the necessary antenna impedance, as is known in the art. The impedance increases as point 16 is moved farther away from the edge of the slot. The length L of the slot is selected to be approximately about ½ wavelength in the desired frequency band to be received by the antenna. For example, FM signals are broadcast between 88 and 108 MHz and ½ wavelength corresponds to about 1.5 meters.

Figure 2:
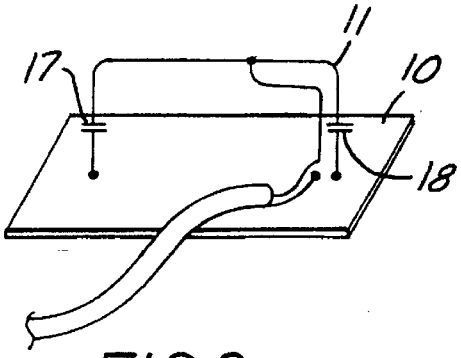
FIG. 2 is a perspective view showing the addition of capacitors to the antenna of the invention.

The slot antenna of FIG. 1 with a slot length adapted to receive FM signals would be insensitive to AM signals since the longer wavelengths of AM signals would not excite the slot and would be lost to the ground plane. In an alternative embodiment as shown in FIG. 2, a pair of capacitors 17 and 18 are inserted between conducting loop 11 and ground plane 10. The capacitance of the capacitors is selected to provide a low impedance at FM frequencies so that they have no impact on antenna performance at FM frequencies. However, the capacitance is selected to provide a high impedance at AM frequencies (530 to 1710 kHz) to isolate AM signals in the conducting loop from the ground plane, thereby obtaining antenna performance as a monopole at AM frequencies. The capacitance may be equal to about 100 picoFarads, for example.

The present invention is especially adapted to be concealed in an automotive vehicle. For a body trim piece (such as a spoiler, a luggage rack, or a roof rack) elevated over a body sheet metal part, the antenna of the invention can be implemented using a minimum of additional parts and at a low cost.

Figure 3A:
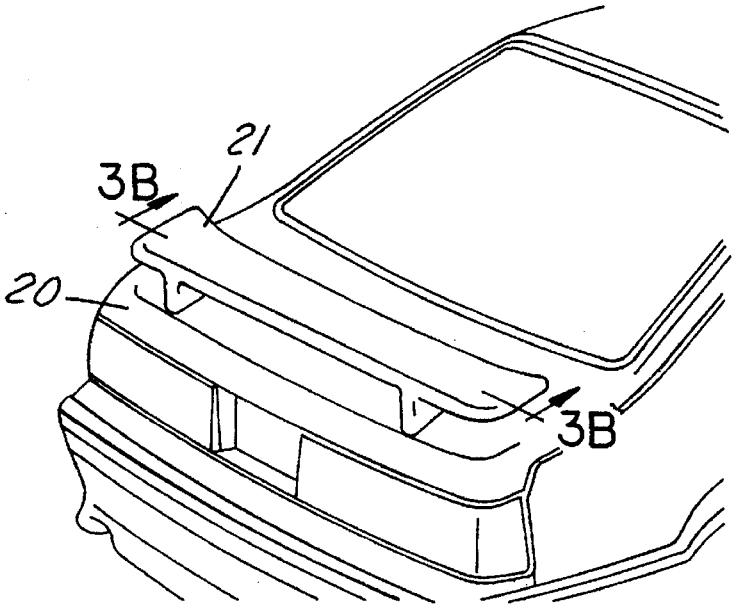
FIG. 3A is a perspective view of a spoiler.
Figure 3B:
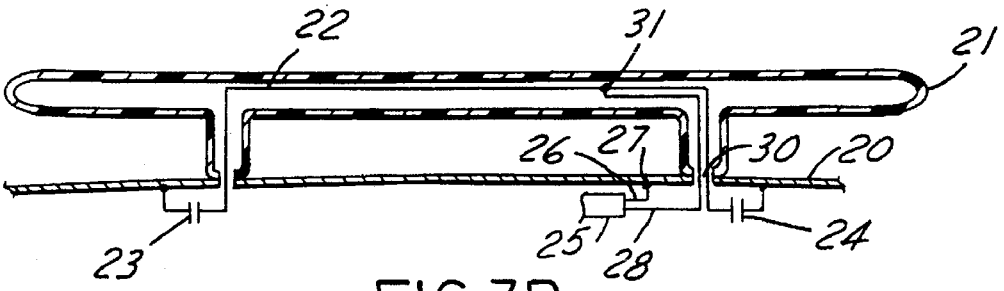
FIG. 3B,is a cross-sectional view of a spoiler including the antenna of the invention.

FIG. 3A shows a perspective view of a wing-shaped spoiler for concealing the antenna of the present invention. A deck lid 20 supports a spoiler 21 such that the deck lid sheet metal provides a ground plane and the spoiler provides a location or concealing the conducting loop forming the slot. FIG. 3B shows the deck lid sheet metal 20 and spoiler 21 in cross-section. Conducting loop 22 is connected to the body sheet metal through capacitors 23 and 24. A coaxial transmission line 25 has a shield conductor 26 connected to sheet metal 20 at a point 27. Coaxial cable 25 has a center conductor 28 passing through a hole 30 m sheet metal 20 into the interior of spoiler 21 for connection with conducting loop 22 at a point 31.

FIG. 4A shows a perspective view of another type of spoiler for implementing the present invention. Rather than being shaped as a wing, spoiler 35 provides a raised surface above deck lid 36 without any gaps therebetween. Spoiler 35 contains a high-mount stop lamp assembly 37. As shown in cross-section in FIG. 4B, a conducting loop 40 is disposed within spoiler 35 and is connected to spoiler mounting bolts 41 and 42 which also provide the electrical connection of conducting loop 40 to the sheet metal panel of deck lid 36. Bolts 41 and 42 may provide integral capacitors for implementing an AM/FM antenna, as described in the related copending application Ser. No.08/540,114. A coaxial cable 43 has its shield conductor connected to sheet metal panel 36 at a point 44 and has its center conductor connected to conducting loop 40 at a point 45. The center conductor passes through a hole 46 in deck lid sheet metal 36 and a hole 47 in spoiler 35.

Typically, the transmission line is connected to the conducting loop fairly close to the side edge of the slot area (i.e., within several inches). Thus, there is little effect upon antenna performance whether the center conductor directly crosses the slot area as shown in FIGS. 1 and 4B or is routed along the side edge of the slot area as in FIGS. 2 and 3B. Likewise, there is little effect upon antenna performance whether the shield conductor of the transmission line is connected directly across the slot from the other connection point or is connected near one of the terminations of the conducting loop.

FIG. 5 shows yet another alternative embodiment of a spoiler. Spoiler 50 has side supports 51 and 52 and center supports 53 and 54, each support having associated mounting bolts. Separate mounting bolts can thus be used for implementing connections or the conducing loop and for the signal connection and ground connection of the transmission line.

Figure 6:
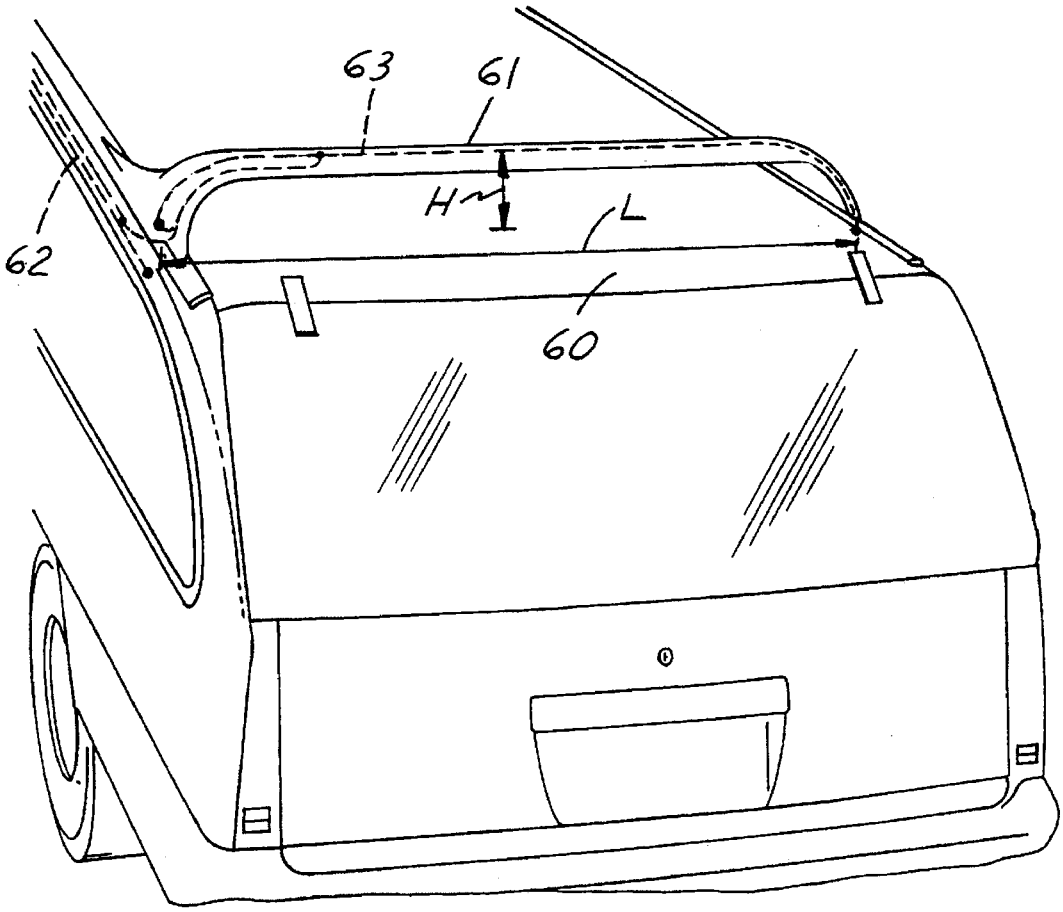
FIG. 6 is a perspective view showing a roof luggage rack and an antenna contained therein.

FIG. 6 shows an alternative embodiment wherein the antenna of the invention is concealed within a roof luggage rack. A roof sheet metal panel 60 provides a ground plane and a raised roof rack crosspiece 61 conceals a conducing loop. A coaxial cable 62 concealed within the roof structure has its shield conductor connected to the roof panel and has its center conductor connected to conducting loop 63 within crosspiece 61.

Spoilers and luggage or cargo racks are typically manufactured from plastic and are thus nonconductive. By minimizing the amount of metal around the top and sides of the slot, an omnidirectional antenna reception pattern is achieved.

Figure 7:
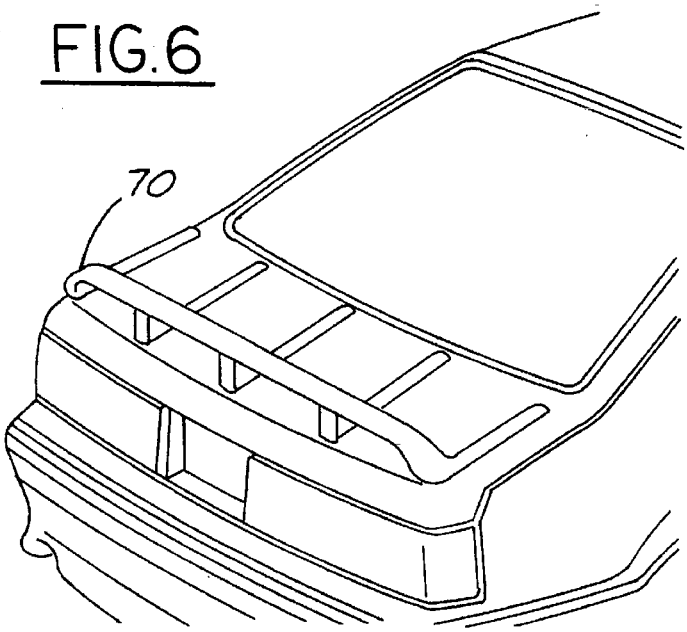
FIG. 7 is a perspective view showing a trunk mounted luggage rack.

In an alternative embodiment as shown in FIG. 7, the body trim piece may itself be formed of a conducting material. Thus, a luggage cage 70 having a metal structure is mounted on a deck lid 71. Cage 70 includes a raised horizontal conducting piece and at least a pair of vertical conducting pieces extending between the horizontal conducting piece and the deck lid sheet metal. The resulting slot may be connected to a transmission line as described in the previous embodiments.

What is claimed is:

1. A multi-band vehicular antenna for receiving signals in first and second radio-frequency bands, said antenna comprising:

a sheet metal ground plane;

a body trim piece elevated over said ground plane;

a conducting loop passing through said trim piece and connected to said ground plane at first and second points, whereby said conducting loop circumscribes a slot area between said sheet metal ground plane and said conducting loop;

a transmission line having first and second conductors, said first conductor being connected to said ground plane at a third point, and said second conductor being connected to said conducting loop at a fourth point located along said slot area between said first and second points and first and second capacitors coupling said conducting loop to said sheet metal ground plane at said first and second points, respectively, said capacitors providing a low impedance to said first band and a relatively higher impedance to said second band so that said antenna operates in a slot antenna mode in said first band and in a monopole antenna mode in said second band.

2. The antenna of claim 1 wherein said third point proximate to said first point.

3. The antenna of claim 1 wherein said third point is located between said first and second points.

4. The antenna of claim 3 wherein said third point is located opposite from said fourth point across said slot.

5. The antenna of claim 1 wherein said slot has a length adapted to receive signals in the FM broadcast band, and wherein said first and second coupling capacitors each has a capacitance providing a low impedance to FM signals and a relatively higher impedance to AM signals.

6. The antenna of claim 1 wherein said sheet metal ground plane is comprised of a deck lid, and wherein said body trim piece is comprised of a spoiler.

7. The antenna of claim 1 wherein said sheet metal ground plane is comprised of a roof panel, and wherein said body trim piece is comprised of a roof rack.

8. A dual slot/monopole antenna for a vehicle, comprising:

a slot formed between a sheet metal body panel and a conducting loop suspended over said sheet metal body panel, said conducting loop having opposite ends coupled to said sheet metal body panel through a pair of capacitors, said slot having a predetermined length; and a transmission line having a first conductor connected to said sheet metal body panel and a second conductor connected to said conducting loop at a point located between said opposite ends;

said dual slot/monopole antenna functioning as a slot antenna at frequencies where said capacitors provide a low impedance and functioning as a monopole antenna at frequencies where said capacitors provide a relatively higher impedance.

9. The antenna of claim 8 further comprising an exterior body trim piece for carrying said conducting loop.

* * * * *